US006536103B1

(12) United States Patent
Holland et al.

(10) Patent No.: US 6,536,103 B1
(45) Date of Patent: Mar. 25, 2003

(54) TOOL FOR INSTALLING A COAXIAL CABLE CONNECTOR

(75) Inventors: Michael Holland, Santa Barbara, CA (US); Yeh Min-Hua, Taipei (TW)

(73) Assignee: Holland Electronics, LLC, Ventura, CA (US)

( * ) Notice: Subject to any disclaimer, the term of this patent is extended or adjusted under 35 U.S.C. 154(b) by 227 days.

(21) Appl. No.: 09/645,816

(22) Filed: Aug. 24, 2000

(51) Int. Cl.[7] ..... H01B 13/00

(52) U.S. Cl. ..... 29/828; 29/762; 29/764; 81/9.41; 140/106; 7/107; 7/158

(58) Field of Search ..... 29/745, 729, 700, 29/564.4, 566.4, 751, 753; 30/90.1, 90.2; 81/9.41, 9.42, 9.43; 7/107, 158; 72/125; 78/416, 409.06, 409.11; 140/106, 123

(56) References Cited

U.S. PATENT DOCUMENTS

| | | | | | |
|---|---|---|---|---|---|
| 3,970,355 | A | * | 7/1976 | Pitschi | 339/117 |
| 4,345,375 | A | * | 8/1982 | Hayward | 30/90.1 |
| 4,746,305 | A | * | 5/1988 | Nomura | 439/319 |
| 5,295,864 | A | * | 3/1994 | Birch et al. | 439/578 |
| 5,595,219 | A | * | 1/1997 | Deuel et al. | 140/123 |
| 6,314,779 | B1 | * | 11/2001 | Kesinger | 72/125 |

* cited by examiner

*Primary Examiner*—Gregory L. Huson
*Assistant Examiner*—Huyen Le

(74) *Attorney, Agent, or Firm*—Michael G. Petit

(57) ABSTRACT

A coaxial cable installation tool useful for folding back an exposed portion of grounded shielding on the end of a coaxial cable in preparation for the attachment of the coaxial cable to a coaxial cable connector. In a preferred embodiment, the installation tool includes a handle portion that is adapted to be comfortably grasped by an installer, and a flaring tool recessed within one end of the handle portion. The flaring tool includes a spring-loaded cylindrical flaring rod slidably mounted within a coaxial tubular housing. The flaring rod has a cylindrical receptacle in the leading end thereof, the diameter of the cylindrical receptacle being dimensioned to receive the portion of the coaxial cable underlying the grounded shielding therewithin. The inner diameter of the receptacle permits the snug insertion of a variety of coaxial cable connectors, such as, for example, F-type connectors, thereinto. As the partially prepared end of a coaxial cable is inserted into the axially disposed cylindrical receptacle in the flaring rod, an annular shim on the leading end of the flaring rod separates the grounded shielding from the underlying dielectric layer. Further advancement of the cable into the receptacle separates the entire exposed portion of grounded shielding from the dielectric layer. Further pressure on the cable urges the flaring rod rearwardly into the tubular housing. As the flaring rod moves rearwardly, the leading end of the tubular housing folds the separated grounded shielding to overlie the cable jacketing. An axial opening in the trailing end of the cylindrical receptacle receives the exposed portion of the central conductor of the coaxial cable thereby preventing the blunting or bending thereof.

2 Claims, 3 Drawing Sheets

TOOL FOR INSTALLING A COAXIAL CABLE CONNECTOR

BACKGROUND OF THE INVENTION

1. Field of the Invention

The invention relates generally to coaxial cable connectors and more particularly to a tool for preparing the end of a coaxial cable for attachment to a male coaxial cable connector.

2. Prior Art

The extended frequency spectrum currently used in cable TV and satellite signal distribution cables, ranging from 5–2000 MHz, together with the present spectrum saturation of airborn signals, have required the industry to increase coaxial cable shielding to reduce radiation of in-cable signals and ingress of unwanted airborn signals. The FCC has created stringent requirements for Cable TV (CATV) connectors, with penalties for Cable TV systems that exceed allowable radiation levels. For this reason, coaxial cable shielding braids have increased from 40% coverage to quad-shielding types consisting of two layers of metallic foil and two layers of 60% braided coverage. Due to economic constraints, the braid materials used for grounded shielding has changed from a mesh comprising soft copper wires to a larger mesh comprised of 0.006-inch rigid aluminum wire.

In the past, when RF shielding was not critical, the coaxial cable connectors, specifically, F-type connectors, only required the braid of the coaxial cable to be cut off prior to insertion into the connector and crimping. The present state-of-the-art connectors are designed to provide a high level of shielding and thus require the shielding braid to be "prepared" prior to insertion into the connector. In order to attach an end of a coaxial cable to a coaxial cable connector, the end of the coaxial cable must first be prepared. During preparation of an end of the coaxial cable, an insulative outer jacket on the cable is first stripped back to expose a layer of braided shielding concentrically overlying a dielectric layer and an electrically conductive central conductor. The end of the cable is also stripped such that the end of the central conductor projects beyond the exposed end of the dielectric layer. The exposed layer of braided shielding is then separated from the underlying dielectric layer, then flared and folded back over the insulating outer jacket adjacent thereto. When the foregoing steps have been completed, the end of the coaxial cable is "prepared", and is ready to be inserted within the axial bore of a coaxial cable connector for attachment thereto.

When the prepared end of the coaxial cable is advanced into the axial bore of a male coaxial cable connector, a sharp cylindrical shank coaxially disposed within the axial bore intercepts the prepared end and separates the braided shielding and insulating jacket from the dielectric layer of the coaxial cable and becomes interposed therebetween. Advancement of the cable into the connector bore continues in this manner until the exposed central conductor of the cable emerges from the opposing end of the connector's axial bore. In general, the amount of force required to advance the prepared end of a coaxial cable into the connector bore is proportional to the length of the cylindrical shank portion of the connector and the "profile" of an annular barb disposed on the shank. The annular barb is wedge-shaped, and not only forces the braiding and jacket radially outward (i.e., away from the concentrically underlying dielectric layer) when the cable is advanced through the bore, but also serves to anchor the cable to the connector following compression or crimping.

Most of the coaxial cable used for CATV applications has an outer jacket having an outer diameter of less than ⅜ inch. The layer of grounded shielding underlying the jacket is comprised of a plurality of sharp, 0.006 inch diameter strands of aluminum wire, the braid being substantially sturdier than the relatively soft copper wire comprising the mesh braid used on older coaxial cables, which had a soft, fine cloth-like braid that did not puncture the finger. As stated above, in order to prepare the end of the cable for attachment to a connector, the exposed portion of the grounded shielding (braid) must be separated from the underlying dielectric layer and folded back to overlie the adjacent portion of jacket. Lacking a suitable tool, the installer must separate and fold back the grounded shielding with his/her fingers. The cut ends of the wire comprising the grounded shielding of modern coaxial cables are capable of puncturing the skin of the finger. Thus, the cumulative damage to the installer's fingertips, caused by peeling back the grounded shielding on hundreds of cables each day, can be substantial. It would be desirable to have a tool that can separate and fold back the grounded shielding layer of a coaxial cable in preparation for attachment of the cable to a male connector.

SUMMARY

It is a first object of the invention to provide a tool operable for separating and folding back an exposed portion of the grounded shielding layer of a coaxial cable to overlie an adjacent portion of the cable jacket in preparation for attachment of the cable to a male coaxial cable connector.

It is a further object of the invention to provide means enabling a coaxial cable installer to protect his/her fingertips from being accidentally punctured by the cut ends of wires comprising the grounded shielding of a coaxial cable during the preparation of the end of a coaxial cable for attachment to a male coaxial cable connector.

It is a further object of the invention to provide a tool for coaxial cable installation that meets the above stated objectives and is, in addition, portable and inexpensive.

It is yet a further object of the invention to provide a coaxial cable connector installation tool that may be used for flaring and folding the braided shielding on the coaxial cable in preparation for attachment to a coaxial cable connector and which tool further includes means operable for supporting and presenting a male coaxial cable connector for inserting the prepared end of the coaxial cable thereinto for attachment thereto.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1A:
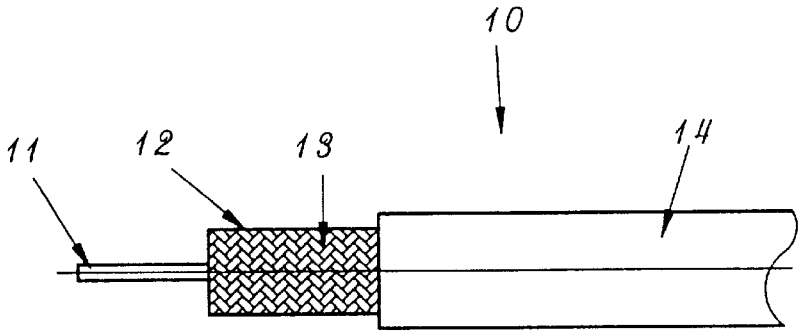
FIG. 1*a* is an elevational view showing the partially prepared end of a coaxial cable.
Figure 1B:
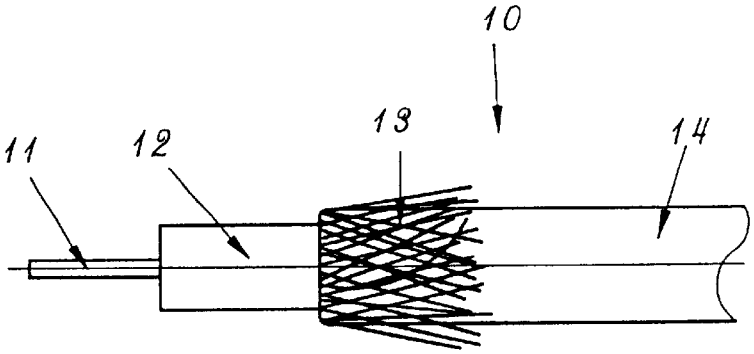
FIG. 1*b* an elevational view showing the end of a coaxial cable illustrated in FIG. 1*a* with the conductive braid folded back to overlie a portion of the protective jacket in preparation for attachment to a coaxial cable connector.

With reference now to FIG. 1*a*, the partially prepared (i.e., stripped) end of a coaxial cable 10 is shown in elevational view. Prior to coupling a coaxial cable to a connector, the end of the cable to receive the connector must first be prepared. A cutting tool (not shown) is used by -an installer to expose a portion of the central conductor 11, a length of the dielectric core 12 and a conductive braid or grounded shielding 13, as shown in FIG. 1*a*. The respective lengths of each of the elements comprising the coaxial cable 10 that are exposed by the cutting tool are in accordance with industry standards. Following exposure of the conductive braid 13, the exposed portion of conductive braid is flared and folded back to overlie the protective jacket 14 as shown in FIG. 1*b*. This grounded shielding flaring/folding step is currently performed by the installer using his/her fingernail and/or fingertips. The coaxial cable 10 may further include one or more layers of an electrically conductive foil (not shown) underlying the conductive braid. The terms "grounded shielding" and "conductive braid" are used interchangeably herein and refer to the electrically conductive layer 13 overlying the dielectric layer 12. The thickness of the conductive braid 13 may vary, depending on the manufacturer, but the wires comprising the conductive braid are sturdier in modern coaxial cables than the material used in the past.

Figure 2:
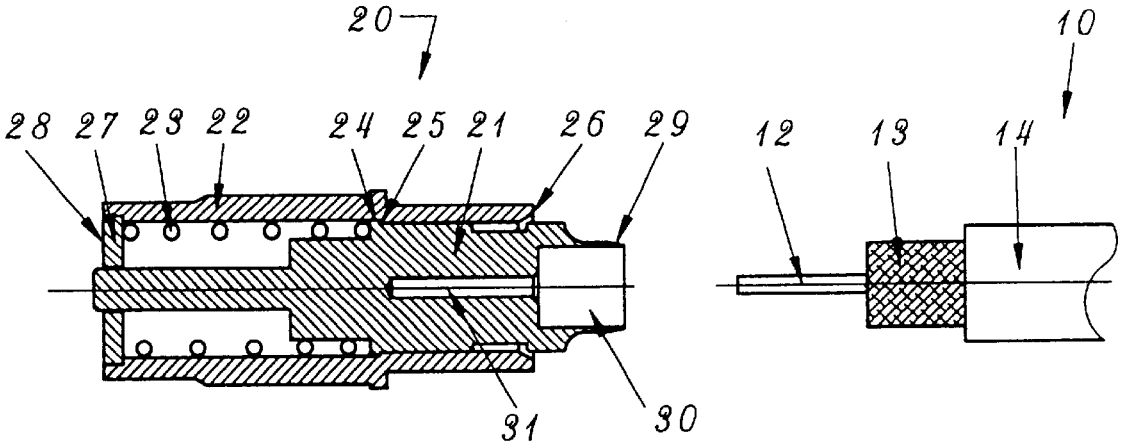
FIG. 2 is a partially cross-sectional view of the leading end of a flaring tool in accordance with the present invention in relation to the partially prepared end of a coaxial cable as shown in FIG. 1*a*.

With reference now to FIG. 2, a partially cross-sectional view of a flaring tool in accordance with the present invention is shown in relation to the partially prepared end of a coaxial cable 10. The flaring tool 20 has a cylindrical flaring rod 21 slidably mounted within an axial conduit 22*a* within a cylindrical folding tube 22. A spring 23 urges the flaring rod 21 forwardly; forcing an annular shoulder 24 on the flaring rod 21 against an annular step 25 disposed near the leading end 26 of the conduit 22*a* within the cylindrical folding tube 22. The spring 23 bears against the shoulder 24 of the flaring rod 21 and a bushing 27 that is press-fitted within the trailing end 28 of the cylindrical folding tube 22. An annular shim 29 at the leading end of the flaring rod 21 provides wedge means for separating the conductive braid 13 from the dielectric layer 12 of the coaxial cable 10. The leading end of the flaring rod 21 has a cylindrical receptacle cavity therein that is dimensioned to receive the portion of the prepared end of the coaxial cable underlying the exposed portion of the conductive braid 13. An axial recess 31 at the trailing end of the receptacle cavity 30 receives the central conductor 12 of the coaxial cable 10 when the portion of the cable comprising the exposed conductive braid 13 is disposed within the receptacle cavity 30.

Figure 3A:
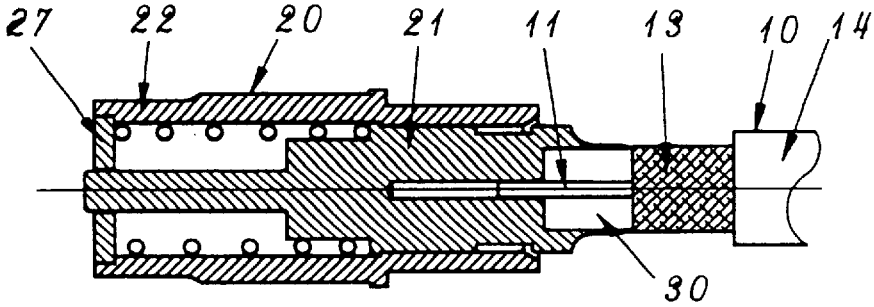
FIG. 3*a* illustrates the insertion of the partially prepared end of a coaxial cable into the leading end of a flaring tool in accordance with the present invention.
Figure 3B:
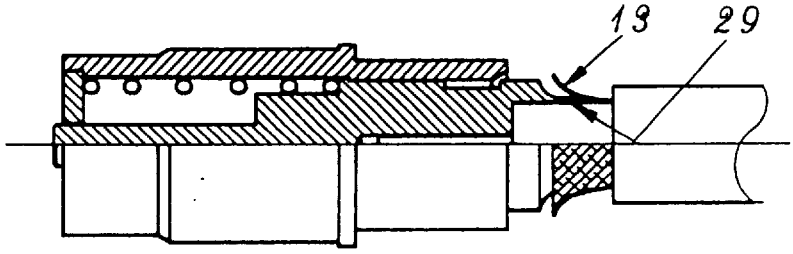
FIG. 3*b* shows further advancement of the cable into the flaring tool with the grounded shielding being flared.
Figure 3C:
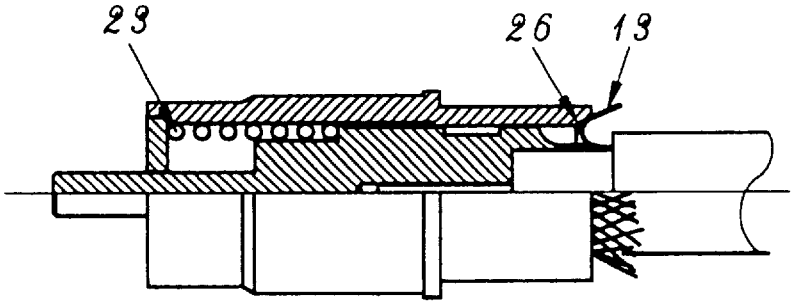
FIG. 3*c* illustrates the grounded shielding being folded back over the cable jacket in response to the continued advancement of the cable into the flaring tool.
Figure 3D:
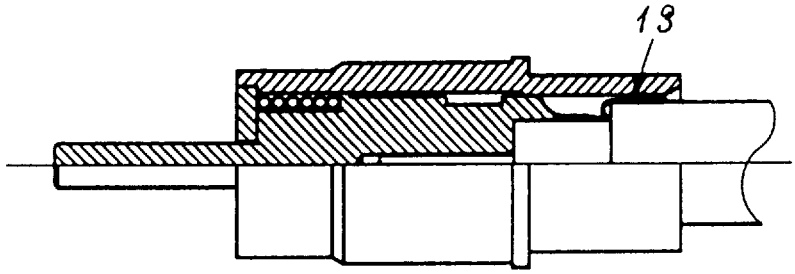
FIG. 3*d* shows the end of the coaxial cable fully advanced into the flaring tool and ready for removal therefrom.
Figure 4:
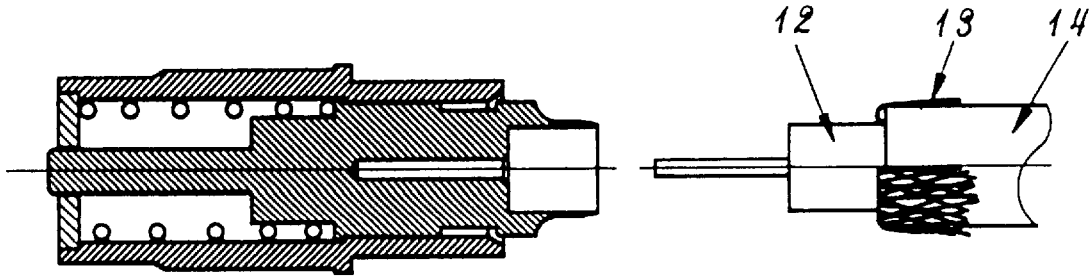
FIG. 4 is a partially cross-sectional view of the fully prepared end of a coaxial cable, as shown in FIG. 1*a*, after the cable is removed from the flaring tool following the step shown in FIG. 3*d*.

The operation of the flaring tool is illustrated sequentially in FIGS. 3*a–d*. FIG. 3*a* shows the partially prepared end of a coaxial cable 10 inserted into the receptacle cavity 30 within the leading end of a flaring rod 21 comprising a flaring tool 20 in accordance with the present invention. FIG. 3*b* shows the grounded shielding 13 being flared as it is separated from the underlying dielectric layer by the annular shim 29 on the leading end of the flaring rod as the cable is forced into the receptacle cavity 30. The annular shim 29 provides wedge means operable for separating and lifting the conductive braid 13 form the dielectric layer 12 of the cable 10 as the cable 10 is advanced into the cavity 30 in the flaring rod. When the dielectric layer is fully advanced into the receptacle cavity 30 and can be advanced no further thereinto, further pressure on the cable compresses the spring 23 enabling the flaring rod 21 to slide rearwardly within the folding tube 22. FIG. 3*c* illustrates the grounded shielding 13 being folded back over the cable jacket by contact with the leading end 26 of the folding tube in response to the continued advancement of the cable into the flaring tool 20. FIG. 3*d* shows the end of the coaxial cable fully advanced into the flaring tool and ready for removal therefrom. The cable is then removed from the flaring tool with the grounded shielding 13 folded back over the cable jacket 14. The end of the cable is "prepared" for attachment to a coaxial cable connector.

Figure 5:
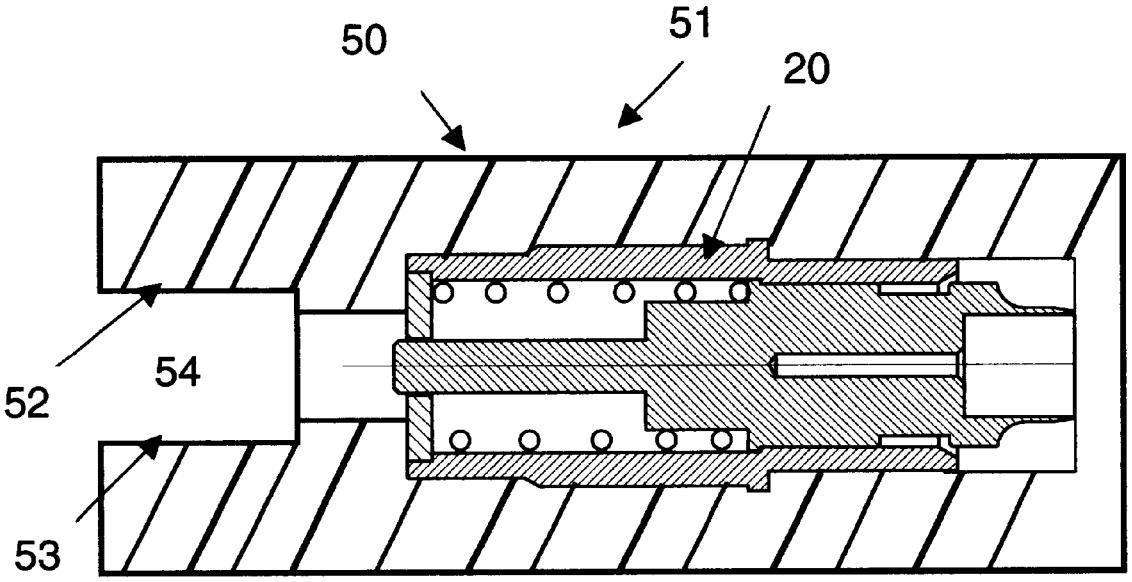
FIG. 5 is a cross-sectional elevational view showing the flaring tool housed within a handle portion that can be easily and comfortably grasped by a cable installer during use.

FIG. 5 is a cross-sectional elevational view of a coaxial cable connector installation tool 50 showing the flaring tool 20 housed within a handle portion 51 that can be easily and comfortably grasped by a cable installer during use. The handle portion 51 may include a cylindrical cavity 53 therewithin dimensioned to snugly accommodate a ferrule 52 therewithin. The ferrule 52 is preferably a molded rubber elastomer but may be made from aluminum, steel or any durable material. The ferrule 52 has a cylindrical coaxial cable connector-holding cavity 54 therewithin, dimensioned to snugly accommodate a male coaxial cable connector (not shown) therewithin in preparation for attachment of the prepared end of a coaxial cable thereto.

In summary, the present invention discloses a flaring tool operable for safely performing a step in the preparation of the end of a coaxial cable for attaching a coaxial cable connector thereto. More particularly, the flaring tool is operable for performing the step of folding an exposed portion of a cable's conductive braid to overlie an adjacent portion of the cable's insulating jacket. The flaring-tool comprises a tubular housing, preferably fabricated from a metal such as brass, the housing having a leading end and a trailing end and an axial bore or conduit therebetween. A flaring rod is coaxially disposed within said axial conduit and mounted to reciprocally slide within the conduit in an axial direction. The flaring rod has a leading end having a cylindrical receptacle cavity therein. The cylindrical receptacle cavity is circumscribed at a leading end thereof by an annular shim. The diameter of the cylindrical receptacle cavity is substantially equal to the diameter of the dielectric layer of the coaxial cable and is operable for separating the conductive braid from the dielectric layer and flaring the braid when the partially prepared end of a coaxial cable is pressed against the leading end of the flaring rod and advanced into the receptacle cavity. The receptacle cavity receives the dielectric layer and central conductor as the end of the cable is advanced into the flaring tool. A compressed spring disposed within the axial conduit of the tubular housing urges the flaring rod toward said leading end of the tubular housing. When the annular shim on the flaring rod underlies the exposed portion of the conductive braid, further advancement of the cable into the flaring tool causes the spring to compress thereby permitting the flaring rod to slide rearwardly toward the trailing end of the tubular housing. The leading end of the tubular housing folds the conductive braid back over the cable jacket as the flaring rod moves rearwardly. The cable is then withdrawn from the flaring tool, ready for attachment to a coaxial cable connector. The flaring tool is preferably housed within a handle that is contoured to be comfortably held in the hand.

In another embodiment of the invention, the handle that houses the flaring tool in one end thereof and a related cable connector installation tool in the opposing end of the handle. In a preferred embodiment, shown in FIG. 5, the cable installation tool 50 has a flaring tool 20, as described above, in one end of a handle 51. The opposing end of the handle 51 houses a cable insertion tool operable for holding a male coaxial cable connector while the prepared end of a coaxial cable is inserted into the connector's axial bore and advanced thereinto. The cable insertion tool comprises a cylindrical ferrule 52, which may be fabricated from either a metallic or an elastomeric material, affixed to a cavity 53 in the handle 51. The ferrule has an open end dimensioned to permit the passage of the male coaxial cable connector therethrough, and a connector-holding cavity 54 disposed rearward of the open end of the ferrule. The connector-holding cavity is preferably either cylindrical or a rearwardly tapering cone or frustum of a cone. A portion of the cavity may be hexagonal. Whatever the shape, the cavity is dimensioned to snugly accommodate a portion of the male coaxial cable connector therewithin.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What we claim is:

1. A flaring tool operable for folding an exposed portion of a conductive braid on a coaxial cable to overlie an adjacent portion of an insulating jacket layer on the coaxial cable in preparation for attachment of the coaxial cable to a coaxial cable connector, the flaring tool comprising:

a. a tubular housing having an axial conduit, a leading end and a trailing end;

b. a flaring rod coaxially and slidably mounted within said axial conduit to reciprocally slide therewithin, said flaring rod having a cylindrical receptacle cavity in a leading end thereof, said cylindrical receptacle cavity being circumscribed by an annular shim at a leading end thereof; and c. a compressed spring disposed within said axial conduit, said spring being operable for urging said flaring rod toward said leading end of said tubular housing;

wherein said cylindrical receptacle cavity further comprises a opening disposed in a trailing end thereof, said opening enabling the passage of an exposed portion of a central conductor within the coaxial cable therethrough and wherein the conductive braid of the coaxial cable concentrically overlies a cylindrical dielectric layer having a dielectric layer diameter wherein said cylindrical receptacle cavity has a diameter equal to said dielectric layer diameter.

2. A coaxial cable connector installation tool useful for attaching a partially prepared end of a coaxial cable to a coaxial cable connector comprising:

(a) a substantially cylindrical body portion dimensioned to be comfortably grasped by a hand and having a flaring tool receptacle in one end thereof and a coaxial cable connector receptacle in an opposing end thereof; and (b) a flaring tool housed within said flaring tool receptacle, wherein said flaring tool comprises:

(c) a tubular housing having an axial conduit, a leading end and a trailing end;

(d) a flaring rod coaxially and slidably mounted within said axial conduit to reciprocally slide therewithin, said flaring rod having a cylindrical receptacle cavity in a leading end thereof, said cylindrical receptacle cavity being circumscribed by an annular shim at a leading end thereof, and (e) a compressed spring disposed within said axial conduit, said spring being operable for urging said flaring rod toward said leading end of said tubular housing.

* * * * *